US006412528B1

(12) United States Patent
Alex et al.

(10) Patent No.: US 6,412,528 B1
(45) Date of Patent: Jul. 2, 2002

(54) SIPHONING PUMP APPARATUS

(76) Inventors: Peter Alex, R.R. #2, Cloverville Antigonish Co., Nova Scotia (CA), B2G 2K9; Johnny Laureijs, P.O. Box 760, 109 Poplar Street, Stellarton, Nova Scotia (CA), B0K 150; Ronald R. Chisholm, 189 Lyman ST, Truro, Nova Scotia (CA), B2N 455

( * ) Notice: Subject to any disclaimer, the term of this patent is extended or adjusted under 35 U.S.C. 154(b) by 0 days.

(21) Appl. No.: 09/949,878

(22) Filed: Sep. 12, 2001

(30) Foreign Application Priority Data

Sep. 19, 2000 (CA) ..... 2320045

(51) Int. Cl.[7] ..... B65B 39/00; B67C 11/04

(52) U.S. Cl. ..... 141/323; 141/21; 141/25; 141/26; 137/123; 137/147; 137/151

(58) Field of Search ..... 141/21–29, 311 R, 141/323; 137/355.16, 572, 614.04, 123, 142, 143, 147, 150, 151; 222/309, 324, 383.1

(56) References Cited

U.S. PATENT DOCUMENTS 4,112,963 A * 9/1978 Brubaker
4,232,694 A * 11/1980 Williams
4,301,826 A * 11/1981 Beckerer ..... 137/149
5,046,645 A * 9/1991 Hagan et al. ..... 137/516.29
5,052,443 A * 10/1991 Evangelist
5,244,021 A * 9/1993 Hau
5,333,639 A * 8/1994 Nelson ..... 137/150
5,392,957 A * 2/1995 Parsons
5,597,097 A * 1/1997 Morris
5,624,059 A * 4/1997 Lo ..... 222/309
5,638,872 A * 6/1997 Porter
5,718,260 A * 2/1998 Leonardi

* cited by examiner

*Primary Examiner*—Timothy L. Maust
(74) *Attorney, Agent, or Firm*—Palmer C. DeMeo

(57) ABSTRACT

A manually operative siphoning pump apparatus for transferring liquid from one container to another container. The siphoning pump apparatus has a hollow cylindrical pump body through which liquid from one container to another can flow and a bellows attached thereto for establishing a vacuum within said pump body. The hollow pump body has a inlet pipe and an outlet an elongated flexible hose or tube connected to each of the pipes. The siphoning pump apparatus has an axially movable valve within the hollow pump body for initiating, controlling and shutting off the flow of liquid through the pump body during the siphoning process and, hence, from one container to another container. The axially movable valve has a cylindrical head at one end thereof and a connector at the opposite end thereof for fixing it to the bottom of the bellows. The axially movable valve is manually controlled by an elongated lever arm pivotally attached to a housing handle at one end and fixedly attached to the bottom of the bellows.

19 Claims, 5 Drawing Sheets

SIPHONING PUMP APPARATUS

BACKGROUND OF THE INVENTION

1. Field of the Invention

This invention relates generally to transferring a liquid from one container to another container. More specifically, it relates to transferring the liquid by means of a hand-held, siphoning pump apparatus.

2. Description of the Related Art

It is old and well known in the art to utilize a piston device to facilitate the siphoning action to transfer liquid from one container to another container such as taught in U.S. Pat. Nos. 4,112,963 and 4,232,694. Other prior art devices are known for facilitating the siphoning of liquid from one container to another by utilizing a bellows device in the transfer tubing between the two containers.

SUMMARY OF THE INVENTION

None of the prior art described above discloses a means for expeditiously and cleanly shutting off the siphoning action between two containers when the container being filled has reached a desired level. This is precisely the purpose of this invention: a siphoning apparatus that incorporates a shut-off mechanism that will prevent overfilling of the container being filled. This invention will eliminate messy spills, reduce waste in the liquid being transferred (important, especially if the liquid is fuel) and eliminate a potential fire hazard around hot machinery when the liquid is highly flammable. In operation, the siphoning pump apparatus of this invention has an inlet hose or tube inserted in a liquid supply container and an outlet nozzle inserted in the opening of a liquid receiving container which is positioned at a lower height than the liquid supply container. A practical example of use for the siphoning pump apparatus of this invention would be to fill a small container with gasoline from a storage tank.

The siphoning pump apparatus of this invention comprises a main housing including a cylindrically hollow pump body attached to a bellows and a shut-off valve attached to the bottom of the bellows and movable axially within the pump body. The hollow pump body has an inlet pipe and an outlet pipe oppositely connected to the cylindrically hollow pump body. A flexible hose or tube is attached to the inlet pipe by an intermediate connector and a flexible hose or tube is attached to the outlet pipe by an intermediate connector. Connected between the inlet side of the pump body and the bellows is a mechanism for priming and pumping the siphoning pump apparatus to initiate and control the flow of liquid from one container to another, the details of which will be explained below. This mechanism is also used to shut off the flow of liquid from one container to the other; this operation will also be explained below.

It is an object of this invention to provide a hand-held, siphoning pump apparatus which will initiate and facilitate the flow of liquid from one container to another container.

It is another object of this invention to provide a hand-held, siphoning pump apparatus which can manually control the flow of liquid from one container to another container.

It is a further object of this invention to provide a hand-held, siphoning pump apparatus which, during the siphoning process, has a mechanism to easily and quickly shut off the flow of liquid from one container to another container when desired.

Other objects and advantages of the siphoning pump apparatus will become apparent to the reader after reading the description of this invention.

DETAILED DESCRIPTION OF THE INVENTION

Figure 1:
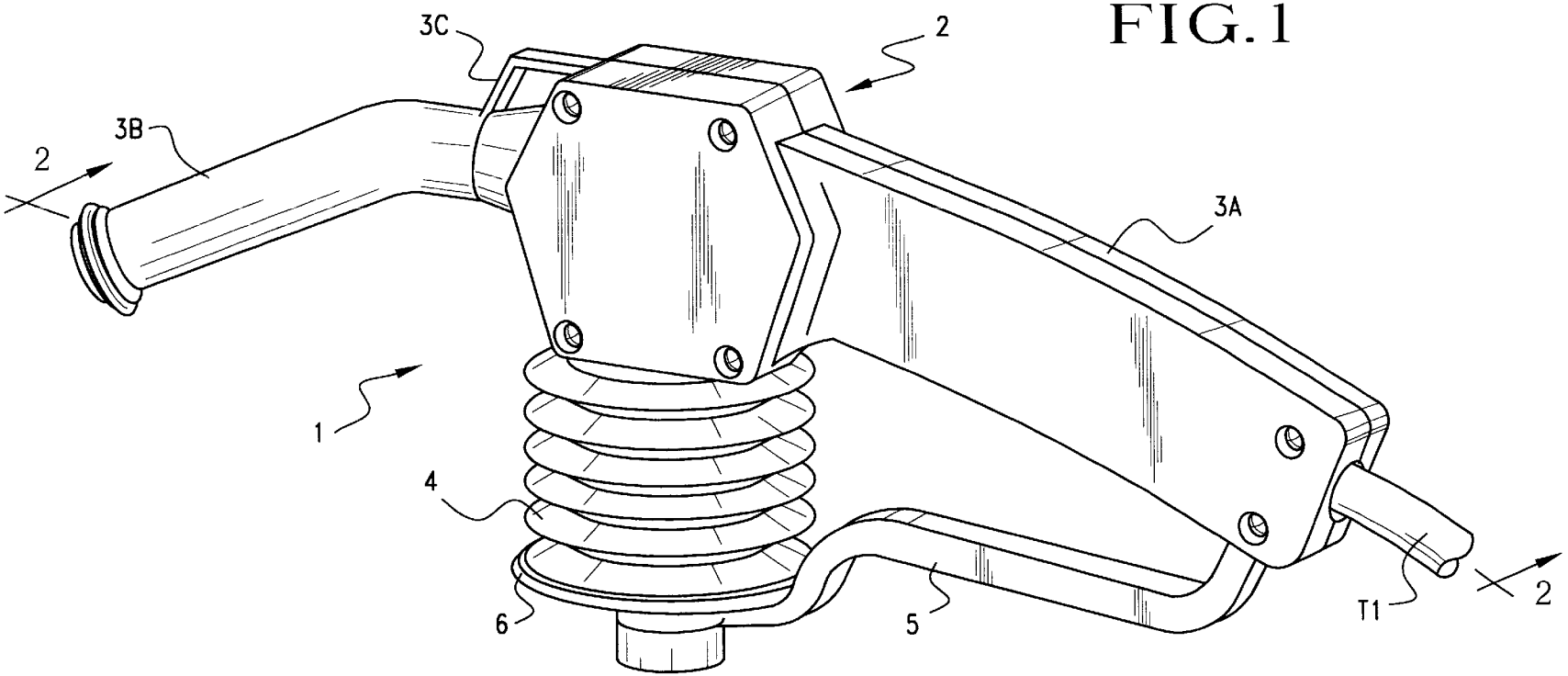
FIG.1 is a perspective view of the siphoning pump apparatus of this invention.
Figure 2:
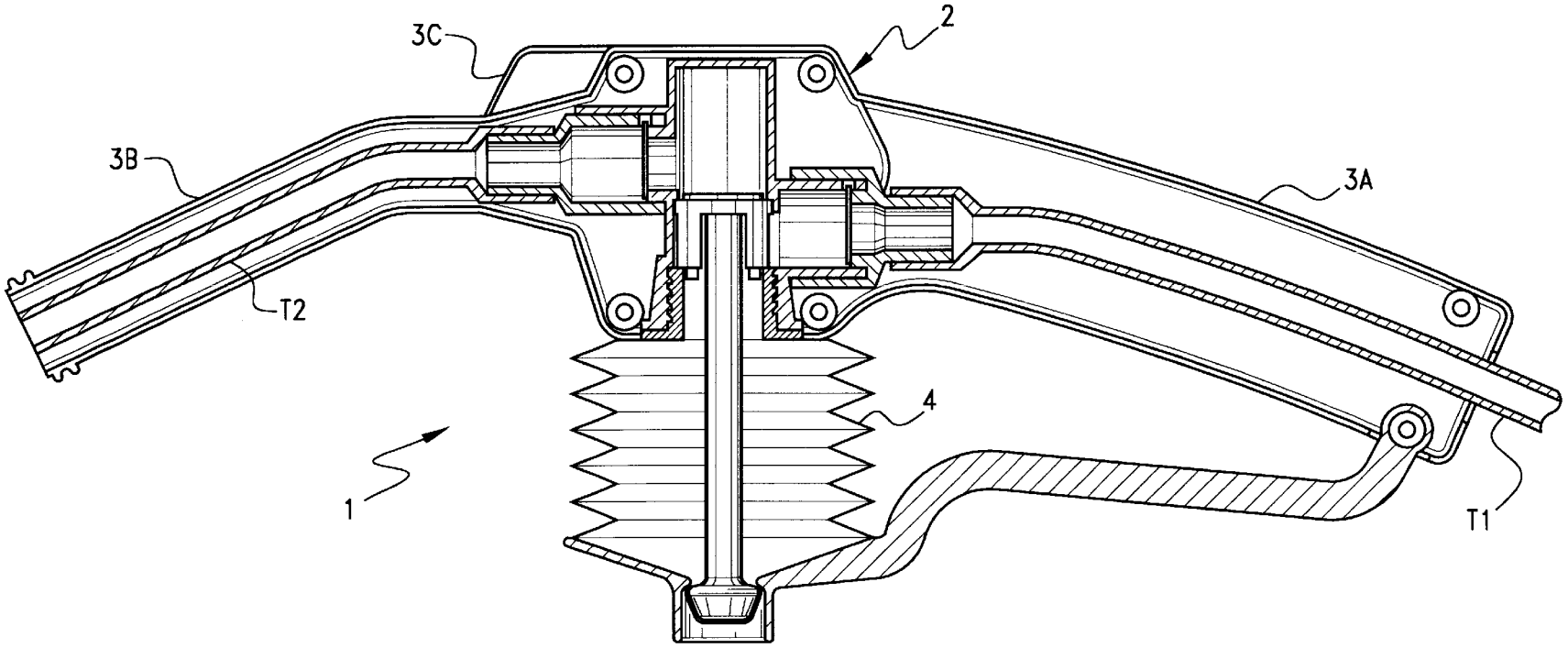
FIG. 2 is a full longitudinal sectional view taken through lines 2—2 of FIG. 1.
Figure 4:
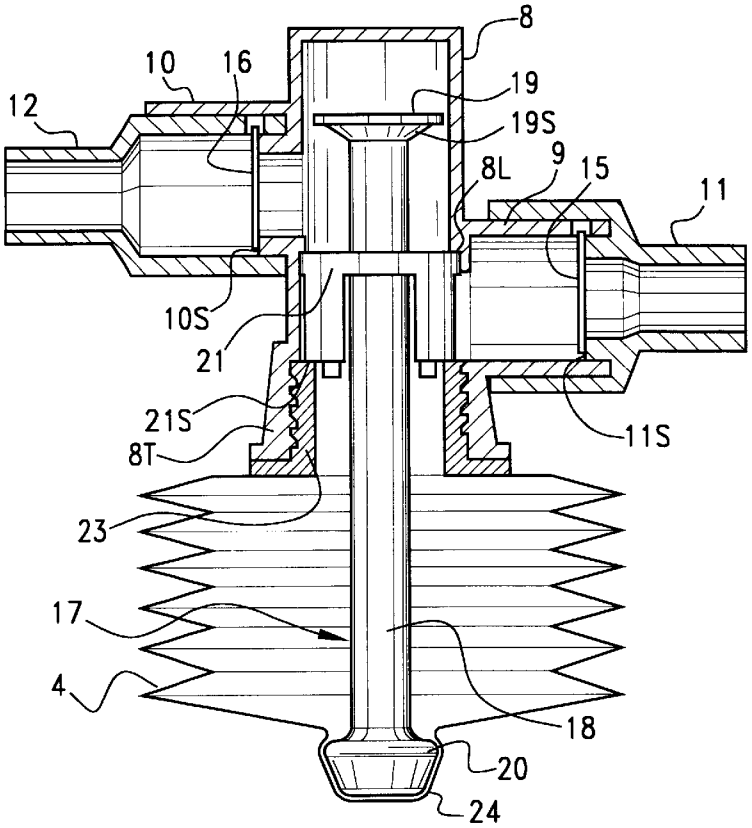
FIG. 4 is a sectional view similar to FIG. 3 but with the poppet valve in an unseated or raised position and with the bellows compressed.
Figure 3:
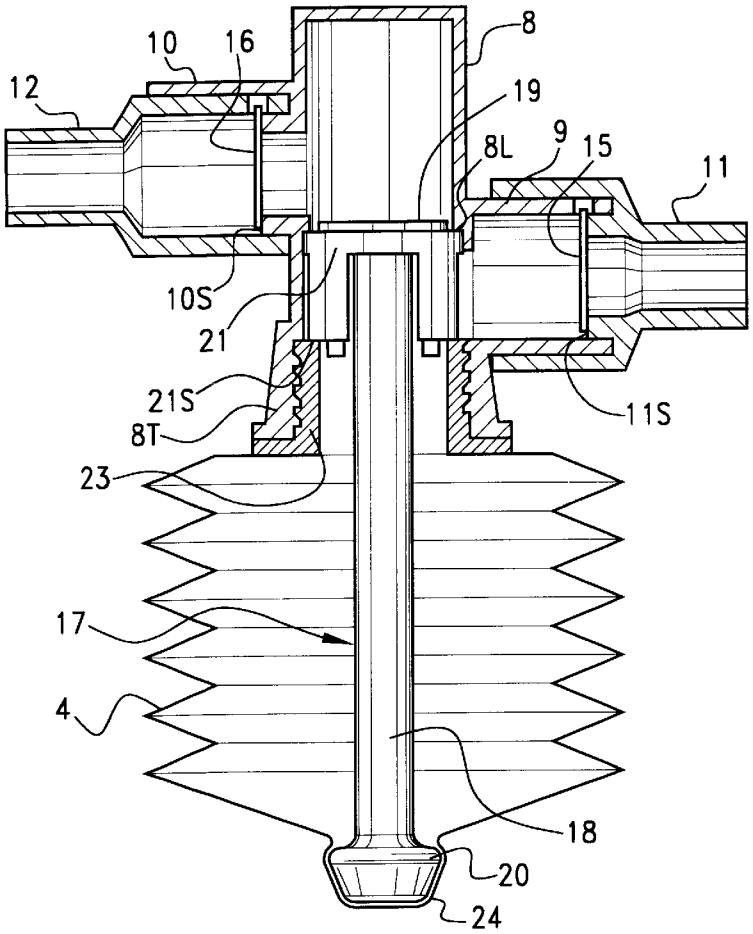
FIG. 3 is a sectional view of the pump and bellows of the siphoning pump apparatus of this invention with the poppet valve in a seated or sealed position.
Figure 5:
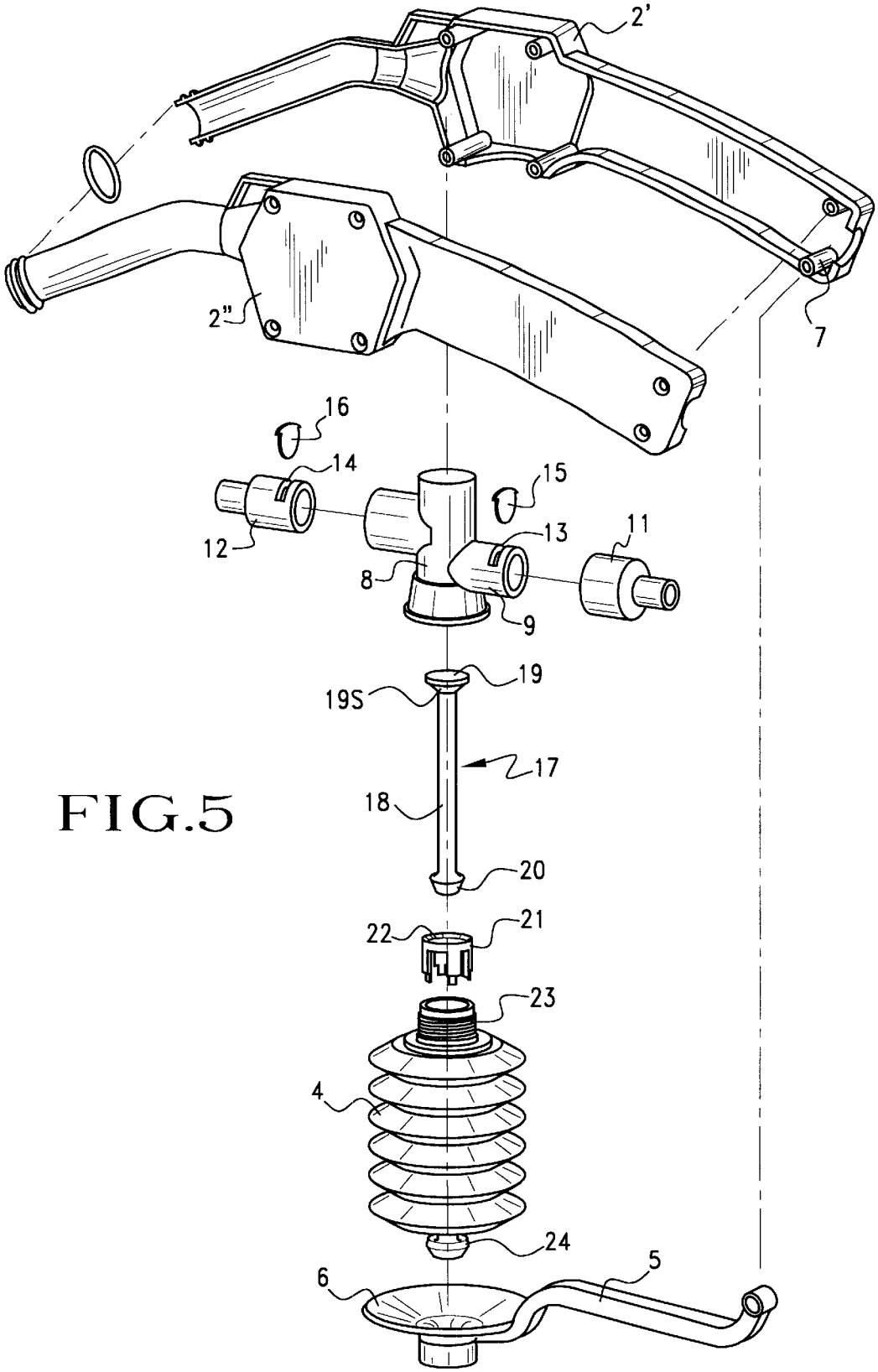
FIG. 5 is an exploded perspective view of the unassembled constituent parts of the siphoning pump apparatus of this invention.

As shown in FIG. 1, the siphoning pump apparatus 1 of this invention has a housing 2 with an extended handle 3A attached to the right side thereof and a tubular nozzle 3B attached to and extending from the left side thereof A bellows 4 extends from the bottom of the housing 2. Between one end of the handle 3 and the bellows 4 there is a lever arm 5 attached, at one of its ends, to the bottom of the bellows 4 by a snap-on disc 6 and, at its opposite end, to the handle 3 by a pivotal stud 7, which also serves as one of the posts for attaching the two half sections 2' and 2" of the housing 2 together. The housing 2 is made from two sections 2' and 2" which are screwed to each other utilizing 6 internly threaded posts or studs (not numbered) on the half-section 2' and 6 screws (not numbered) passing through apertures in the half-section 2". When the two half sections 2' and 2" are fastened together, there is a slight overlap of half section 2' with respect to half section 2" so that the inner components of the siphon pump apparatus 1 cannot be seen externally. Furthermore, each half section 2' and 2" near the open end of the nozzle 3B has a pair of spaced half rings. When the two half sections 2' and 2" have been fastened together by the six screws, a plastic or rubber O-ring is slipped over the front end of the nozzle 3B and between the pair of spaced half rings to further secure the two half sections 2' and 2" of the housing 2 together. A flexible hose or tube T1 (inlet) extends from one end of the handle 3A and another flexible hose or tube T2 (outlet) extends within the nozzle 3B; outlet hose T2 is not shown in FIG. 1 but is shown in FIG. 2. There is a loop 3C on the housing 2 which can be used for storing the siphon pump apparatus 1 on a hook when the apparatus 1 is not in us. The siphoning pump apparatus 1 can be carried by handle 3A and, during the siphoning process, is primed, pumped, controlled and shut-off in conjunction with lever arm 5 (the operation of which will be explained hereinbelow).

Referring now to FIGS. 2, 3, 4 and 5, the internal parts of the siphoning pump apparatus 1 of this invention will be explained. Within the housing 2, there is a pump body 8 that has an inlet tubular connector 9 on one side thereof and an outlet tubular connector 10 on the opposite side thereof, the inlet connector 9 being at a lower position on the pump body 8 than the outlet connector 10. The inner and outer diameters of the inlet connector 9 are slightly smaller than the inner and outer diameters of the outlet connector 10. There is slit 13 extending a short distance into the inlet tubular connector 9 for insertion therein of a flapper type check valve 15, substantially cylindrical in shape. The flapper type check valve 15 has, at the top portion thereof, a pair of opposite extensions (not numbered) which will function as a pivot therefor once placed in the slit 13 of the inlet tubular connector 9. A female hose connector 11 is friction fitted over the inlet connector 9 and has a back stop or inlet seat 11S therein for the flapper type check valve 15. There is slit 14 extending a short distance into the male hose connector 12 for insertion therein of a flapper type check valve 16, similar in structure to the flapper type check valve 15. The male hose connector 12 is friction fitted into the outlet connector 10. Within the outlet connector 10 there is a back stop or outlet seat 10S for the flapper type check valve 16. Thus, during the siphoning process and in view of these flapper type check valves 15 and 16, there can only be liquid flow in one direction, i.e., from the inlet tube T1, through the pump body 8, through the outlet tube T2 and out through the nozzle 3B. When the two sections 2' and 2" of the central housing are fastened together by the four screws and four posts, the inner components such as the pump body 8 and the threaded element 23, attached to the top of the bellows 4, are positioned and fixed within the central housing.

Centrally of the pump body 8 and the bellows 4, there is poppet valve 17 having an elongated cylindrical stem 18 with a larger diameter cylindrical head 19 at the top end thereof and a male retaining bulb 20, at the bottom end thereof, whose outer diameter is slightly larger than the diameter of the elongated stem 16 but smaller than the outer diameter of the cylindrical head 19. The outer diameter of the cylindrical head 19 is slightly less than the inner diameter of the pump body 8 so that it can move freely within the pump body 8. At the top of the bellows 4 is a hollow cylindrical element 23 which is threaded externally. The hollow pump body 8 has an internally threaded portion 8T at the lower end thereof which threaded portion is screwed onto the hollow cylindrical element 23 at the top of the bellows 4 during assembly of the siphon pump apparatus 1. A cylindrical seating element 21 has four legs (not numbered) the ends of which are partial inserted into the threaded cylindrical element 23 at the top of the bellows 4. During the assembly process, the seating element 21 becomes positively fixed between the hollow cylindrical element 23 and an internal ledge 8L within the hollow pump body 8. This seating element 21, which is hollow through its center, has an upper circumferential surface 22 which mates with an external undersurface 19S of the poppet valve's cylindrical head 19 and effects a seal therebetween which seal will cut off the flow of liquid through the pump body 8 during the siphoning operation as will be explained hereinafter. The underside 19S of the cylindrical head 19 may have a tapered or semi-spherical surface which mates or seats on an oppositely tapered or semi-spherical surface 22 on an upper side of the seating element 21. The cylindrical head 19 may incorporate an O-ring on its undersurface 19S in lieu of the tapered or semi-spherical surface for better sealing thereof to the seating element 21.

The male retaining bulb 20 at the bottom of the poppet valve 17 is small enough in diameter to pass through the hollow seating element 21 and the hollow cylindrical element 23 and, thence, through the center of the bellows 4 to a female retaining bulb 24 affixed at the bottom of the bellows 4. During the initial assembly of the siphon pump apparatus 1, the seating element 21 is fixed between the cylindrical head 19 of the poppet valve 18 and the threaded element 23 at the top of the bellows 4. Each of the four legs of the seating element 21 has an indent 21S at its lower end which indent seats upon the upper rim of the bellow's threaded element 23. Once the male retaining bulb 20 of the poppet valve 17 is snapped into the female retaining bulb 24, the threaded portion 8T of the pump body 8 is screwed onto the external threaded element 23 at the top of the bellows 4, thereby centrally positioning the poppet valve 17 within the bellows 4 and pump body 8. It should be pointed out here that, prior to the preceding assembly, the bellows 4 is inherently spring biased in an expanded condition and, subsequent to the preceding assembly, the bellows 4 is slightly compressed. As a result of this latter assembly step, the seating element 21 becomes fixed between the threaded element 23 at the top of the bellows 4 and a ledge 8L in the inner wall of the pump body 8. In operation of the siphon pump apparatus 1, the poppet valve 17 is movable axially within the pump body 8 and the bellows 4. The female retaining bulb 24 attached to the bottom of the bellows 4 is inserted into a snap-on support disc 6 thereby affixing the bellows 4 to the lever arm 5.

A flexible hose or tube T1 of suitable size and length is connected to the inlet hose connector 11 and a flexible outlet hose or tube T2 of suitable size and length is connected to the outlet hose connector 12. The length of the outlet tube or hose T2, for most applications, does not extend beyond the opening in the nozzle 3B. The outer diameter of the oulet hose or tube T2 is slightly less than the inner diameter of the nozzle 3B so that there is little play between the outlet hose T2 and the nozzle 3B. Tubes T1 and T2 may be made of rubber or plastic. Nylon tubing was found to be practical. All other parts and elements of the siphon pump apparatus 1 are made from plastic material, for example, polyethylene. Other plastic materials can also be used. Some of the parts and elements are made from high density plastic material and these parts and elements are made by injection molding. Other parts and elements are made from low density plastic material and these parts and elements are made by blow molding and/or injection molding.

The parts and elements of the siphon pump apparatus 1 which are made from high density plastic material are: the housing 2; seating element 21 and lever arm 5. The other parts and elements of the siphon pump apparatus 1 are made from low density plastic material.

The overall dimensions of the siphon pump apparatus 1 are:

- 11½ inches—horizontally, from the tip of the nozzle 3B to the end of the handle 3A;
- 4½ inches—vertically, from the bottom of the bellows 4 to the top of the housing 2;
- 1½ inches—horizontally, the width of the central housing 2; and
- 2¼ inches—the diameter of the bellows 4 and depth of the central housing 2.

The above dimensions are approximate and may be varied.

Figure 6:
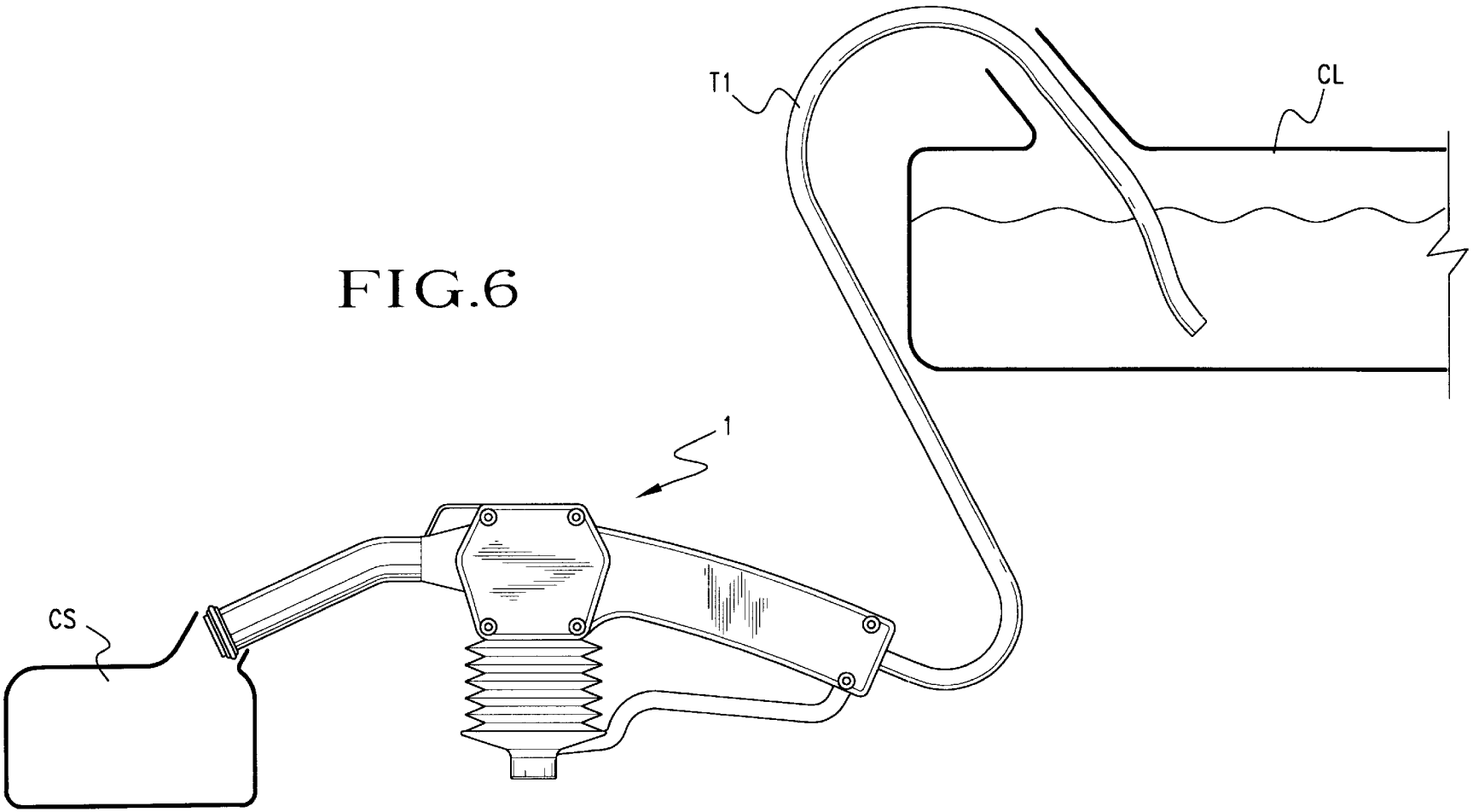
FIG. 6 shows a practical application of the siphoning pump apparatus of this invention.

FIG. 6 shows a practical application of the siphon pump apparatus 1 of this invention. The inlet hose or tube T1 of the siphon pump apparatus 1 is inserted into a storage tank CL containing, e.g., gasoline, and the outlet nozzle 3B is positioned at the opening of a smaller container CS or partially inserted therein. Typically, the storage tank CL is at a higher elevation than the smaller container CS in order for the siphon action to work.

The operation of the siphoning pump apparatus of this invention is as follows:

Make sure that the container from which the liquid to be siphoned is at a higher elevation than the container to be filled with the liquid.

Install a sufficient length of flexible tubing T1 onto the hose connector 11 of the siphon pump apparatus 1 so that the tubing extends out from the end of the handle 3A and into the bottom of the container from which liquid is to be siphoned.

Insert the end of the nozzle 3B of the siphon pump apparatus 1 into the container to be filled with the liquid.

Hold the handle of the siphon pump apparatus 1 in a horizontal position so that the flapper check valves 15 and 16 are seated properly.

Prime the pump body 8 by depressing the lever arm 5 several quick times. As a result of this priming, the following operation results:

1. Lever arm 5 depressed—Bellows outlet stroke
   a) Each time the bellows 4 is compressed, the cylindrical head 19 of the poppet valve 17 is simultaneously lifted or raised from the seating element 21. This allows liquid (or air) to flow out of the bellows 4.
   b) The flapper valve 15 will seat inside the hose connector 11 thus preventing liquid (or air) from flowing through the pump body 8.
   c) The liquid (or air) flowing out from the bellows 4 will force the flapper valve 16 in the hose connector 12 to open.
2. Lever arm 5 released—Bellows inlet stroke
   a) When lever arm 5 is released, the spring effect of the bellows 4 will make the bellows 4 expand. This expansion will attempt to draw liquid (or air) through flapper valve 16 in outlet connector 12 and, thus, the flapper valve 16 will be pushed onto an internal seat 12*a* of the outlet stub 12 in the side wall of the pump body 8.
   b) As the bellows 4 expands, a vacuum is created in the bellows 4 and pump body 8. This condition will allow atmospheric pressure in the container from which liquid is to be siphoned to force flapper valve 15 to open, i e., to be unseated from an internal seat 11*a* inside the inlet hose connector 11.
   c) As the bellows 4 expands further, atmospheric pressure on the liquid in the container, from which the liquid is to be siphoned, will force the liquid through the inlet tubing T1 and into the pump body 8 and bellows 4.

The priming action should continue until clear liquid (no air) flows out from the end of the nozzle 3B; this indicates that the siphoning process is established.

The flow of the liquid from the container (from which the liquid is siphoned), through the inlet tubing T1, valve body 8, nozzle 3B and into the receiving container can be controlled or regulated by the position of lever arm 5. The further the lever arm 5 is squeezed or depressed the farther the cylindrical head 19 of the poppet valve 17 is held off the seating element 21.

When the desired level of liquid is filled within the receiving container, the lever arm 5 is released and the spring effect of the bellows 4 will cause the cylindrical head 19 of the poppet valve 17 to seat on the sealing surface 22 of the seating element 21 and, in effect, shut off the flow of liquid through the siphon pump apparatus 1. This automatic shut off of liquid flow is a unique feature of the siphon pump apparatus 1 of this invention.

When another receiving container is to be filled with the same liquid, then remove the siphon pump apparatus 1 from the container being filled and insert the nozzle 3B into the other receiving container. A simple squeeze or depression of the lever arm 5 of the siphon pump apparatus 1 should reiniiate the siphoning action and the filling of the other container will commence.

Modifications of this invention will be readily apparent to those skilled in the art and it is intended that the invention be not limited by the embodiments disclosed herein but that the scope of the invention be defined by the appended claims.

What we claim is:

1. A manual siphoning pump apparatus for transferring liquid from a first container to a second container, said appararus comprising an elongated, hollow pump body, an inlet pipe extending from and communicating with said pump body, an outlet pipe extending from and communicating with said pump body, an elongated flexible hose or tube connected to each of said inlet and outlet pipes, a poppet valve axially movable within said hollow pump body and operable to allow and prevent liquid from passing from said inlet pipe to said outlet pipe through said hollow pump body, a bellows mounted to and communicating with said pump body, and operating means connected to said poppet valve and said bellows for axially moving said poppet valve and said bellows such that said bellows is usable for initiating a flow of liquid through said hollow valve body when said elongated flexible hose or tube on the inlet side of said pump body is at a higher elevation than said elongated hose or tube on the outlet side of said hollow pump body.

2. The apparatus of claim 1 wherein said operating means is an elongated lever arm attached to said bellows and to a handle which is attached to a housing enclosing said hollow pump body.

3. The apparatus of claim 2 wherein said lever arm is attached to the bottom of said bellows at one end thereof and to a pivotal element on said handle at the opposite end of said lever arm.

4. The apparatus of claim 1 wherein said hollow pump body is cylindrical and said poppet valve has a cylindrical head axially movable within said hollow pump body and being capable of permitting the flow of liquid through said hollow pump body as well as controlling and stopping the flow of liquid therethrough.

5. The apparatus of claim 4 wherein said poppet valve has an elongated stem with said cylindrical head attached at the top end thereof and a connecting part attached to the bottom end thereof for attaching said poppet valve to the bottom of said bellows.

6. The apparatus of claim 5 wherein said poppet valve is axially movable within said hollow pump body by manually actuating said operating means.

7. The apparatus of claim 5 wherein said poppet valve has a cylindrical head at the top end thereof which head has an outer diameter less than the inner diameter of said pump body so that it moves freely therewithin.

8. The apparatus of claim 7 wherein said bellows has an externally threaded cylindrical element affixed to the top end thereof and a cylindrical seating element affixed between the top of said threaded cylindrical element and a cylindrical ledge in the hollow pump body.

9. The apparatus of claim 8 wherein said cylindrical head of said poppet valve is capable of seating in said cylindrical seating element and effecting a seal therebetween.

10. A siphoning pump apparatus for transferring liquid from one container to another, said apparatus comprising a hollow, substantially cylindrical, pump body which is closed at the top and open at the bottom, said pump body having a sidewall with an inlet and an outlet connector, a handle attached to said pump body, an elongated flexible tube being sealingly connected to said inlet connector and an elongated flexible tube being sealingly connected to said outlet connector, a bellows sealingly attached to the bottom of said pump body, a lever connected between said bellows and said handle, an elongated valve within said pump body and said bellows, said elongated valve having a substantially cylindrical head within said pump body for controlling and shutting off the flow of liquid through said pump body during a siphoning operation, and said valve being axially movable within said pump body and operative by means of said lever to control and shut off the flow of liquid through said pump body.

11. The apparatus of claim 10 wherein said valve has an elongated stem with said cylindrical sealing head being attached to the upper end thereof.

12. The apparatus of claim 11 wherein there is a male connecting part at the lower end of said elongated stem for insertion into a female connecting part at the bottom of said bellows.

13. The apparatus of claim 12 wherein one end of said lever is attached to the bottom of said bellows and the opposite end of said lever is pivotally connected to said handle.

14. The apparatus of claim 10 wherein said cylindrical head of said elongated valve has a clearance from said inner sidewall of said pump body so that it can move freely therein.

15. The apparatus of claim 10 wherein there is a seating element fixed within said pump body, said seating element co-acting with said cylindrical head of said elongated valve to form a seal therebetween.

16. The apparatus of claim 10 wherein said pump body has an internally threaded lower portion and said bellows has an externally threaded upper element, said pump body and said bellows being sealingly attached to each other by said threaded lower portion and said threaded upper element.

17. A siphoning pump apparatus for transferring liquid from one container to another container, said apparatus comprising:

pump means for effecting the flow of liquid from said one container to said another container by a siphoning action, means connecting said one container to said another container through said pump means, valve means within said pump means for controlling the flow of liquid through said pump means, means connected between said pump means and said valve means for actuating said valve means within said pump means for effecting the control of liquid through said pump means, and wherein said means connected between said pump means and said valve means are a bellows attached to said pump means and said valve means and a pivotal lever arm attached between said bellows and said pump means.

18. The apparatus of claim 17 wherein said pump means has a sealing element therein.

19. The apparatus of claim 17 wherein said valve means has a movable sealing element.

* * * * *